US005584514A

United States Patent [19]

Mascotte

[11] Patent Number: 5,584,514

[45] Date of Patent: Dec. 17, 1996

[54] WINDOW GUARD LOCKING DEVICE

[76] Inventor: Lawrence L. Mascotte, 9106 SE. 82nd, Portland, Oreg. 97266

[21] Appl. No.: 264,987

[22] Filed: Jun. 24, 1994

[51] Int. Cl.[6] ..... E05C 5/02

[52] U.S. Cl. ..... 292/57; 49/56; 49/141; 292/66; 292/68; 292/217; 292/DIG. 33; 292/DIG. 55; 292/DIG. 53; 292/DIG. 20

[58] Field of Search ..... 292/57, 59, 66, 292/68, DIG. 33, 217, DIG. 55, DIG. 53, DIG. 51, DIG. 20, 251; 411/551, 552, 553; 49/50, 56, 141; 70/DIG. 62

[56] References Cited

U.S. PATENT DOCUMENTS

| | | | |
|---|---|---|---|
| 377,648 | 2/1888 | Sinning | 292/57 |
| 452,776 | 5/1891 | Doty | 292/DIG. 20 |
| 777,456 | 12/1904 | Wands | 292/57 |
| 1,193,148 | 8/1916 | Hornung | 292/57 |
| 1,718,995 | 7/1929 | Barnard | 292/57 |
| 2,839,808 | 6/1958 | Zahodiakin | 411/551 |
| 2,922,211 | 1/1960 | Boyd | 411/551 |
| 3,169,293 | 2/1965 | Neuschotz | 411/552 |
| 3,460,210 | 8/1969 | Ellis | 411/552 |
| 4,127,293 | 11/1978 | Moreno | 292/251 |
| 4,351,170 | 9/1982 | Clompus | 292/DIG. 46 |
| 4,634,157 | 1/1987 | Fernandez | 49/56 |
| 4,702,505 | 10/1987 | Alexander | 292/251 |

FOREIGN PATENT DOCUMENTS

| | | | |
|---|---|---|---|
| 858993 | 12/1970 | Canada | 792/58 |
| 256295 | 12/1971 | United Kingdom | 411/553 |

*Primary Examiner*—Darnell M. Boucher
*Attorney, Agent, or Firm*—Adrian J. LaRue

[57] ABSTRACT

A window guard locking device (34) comprises a flange member (36) having a keyhole (42) therethrough, a member (40) having a central cavity (50), an intermediate member (38) having an opening (46) disposed between the flange member (36) and the member (40) with the axis of the keyhole, the opening and the central cavity being coincident, and at least one projection (48) extending inwardly from a wall of the opening (46) adjacent the keyhole (42) with a surface of the projection (48) being aligned with a respective wall of the keyhole (42).

14 Claims, 3 Drawing Sheets

WINDOW GUARD LOCKING DEVICE

FIELD OF THE INVENTION

The present invention relates to a window guard locking device and more particularly to a window guard locking device that permits the window guard to be easily opened in case of an emergency.

BACKGROUND OF THE INVENTION

Conventional window guard locking devices are secured onto window guards for locking the window guards in position over a window of a building to prevent entry through the window. The window guards are hingedly mounted so that they can be opened when necessary as in the case of an emergency such as a fire.

The conventional window guard locking device has a cylindrical member provided with an outer annular recess and a central hole in communication therewith. A flange having a keyhole therethrough covering the annular recess and in alignment with the central hole is secured to the cylindrical member. A pin extends through the flange and into the bottom surface of the annular recess adjacent the central hole. A locking member in the form of a shaft having a pin adjacent the front end secured therein defining locking lobes is rotatably mounted in a hole in the window frame in alignment with the keyhole in the window guard locking device. An operating handle is mounted on the shaft inside the window to operate the shaft. Thus, with the window guard blocking device secured onto the window guard with the keyhole in a vertical position and the locking member in position with the locking lobes also in a vertical position, the window guard is closed so that the front end of the locking member extends into the central hole of the window guard locking device while the locking lobes extend through the keyhole into the annular recess whereafter the operating handle moves the locking member clockwise whereby the locking lobes move within the annular recess behind the flange until the upper locking lobe engages the pin at about a five-o'clock position thereby locking the window guard in position.

To open the window guard, the operating handle is moved counterclockwise which moves the locking lobes until they are aligned with the keyhole whereupon the locking member can now be free from the locking device by pushing open the window guard.

In the event of an emergency or some one attempts to open the device quickly, the locking lobes can be moved past the keyhole until the bottom locking lobe engages the pin which positions the locking lobes under the flange and not in alignment with the keyhole. In a panic, the operating handle will be moved back and forth to align the locking lobes with the keyhole. The time lost to align the locking lobes with the keyhole may prove to be disastrous.

Accordingly, the present invention overcomes the drawback of misalignment by manually aligning the locking lobes with the keyhole of a window guard locking device by positively aligning the locking lobes with the keyhole when the locking member is moved from a locked position to an unlocked position.

SUMMARY OF THE INVENTION

A window guard locking device securable onto a window guard hingedly mounted onto a building and lockable in a locked position over a window by locking lobes of a moveable locking member extending outwardly from the building adjacent the window, the window guard locking device comprises a member having a central cavity, a flange member having a keyhole therethrough, an intermediate member having an opening with a diameter at least equal to the length of the keyhole secured between the member and the flange member with the axis of the keyhole, the opening and the central cavity being aligned, and opposing projections extending inwardly from a wall of the opening with surfaces of the opposing projections being aligned with respective walls of the keyhole so that when the locking lobes are moved from a locked position under the flange member within the opening to an unlocked position, the locking lobes engage the surfaces of the opposing projections aligned with the respective walls of the keyhole whereby the locking lobes are aligned with the keyhole thereby enabling the window guard locking device to be moved free of the locking member by pushing open the window guard.

BRIEF DESCRIPTION OF THE DRAWINGS

Embodiments of the invention will now be described by way of example with reference to the accompanying drawings in which.

DETAILED DESCRIPTION OF THE INVENTION

Figure 1:
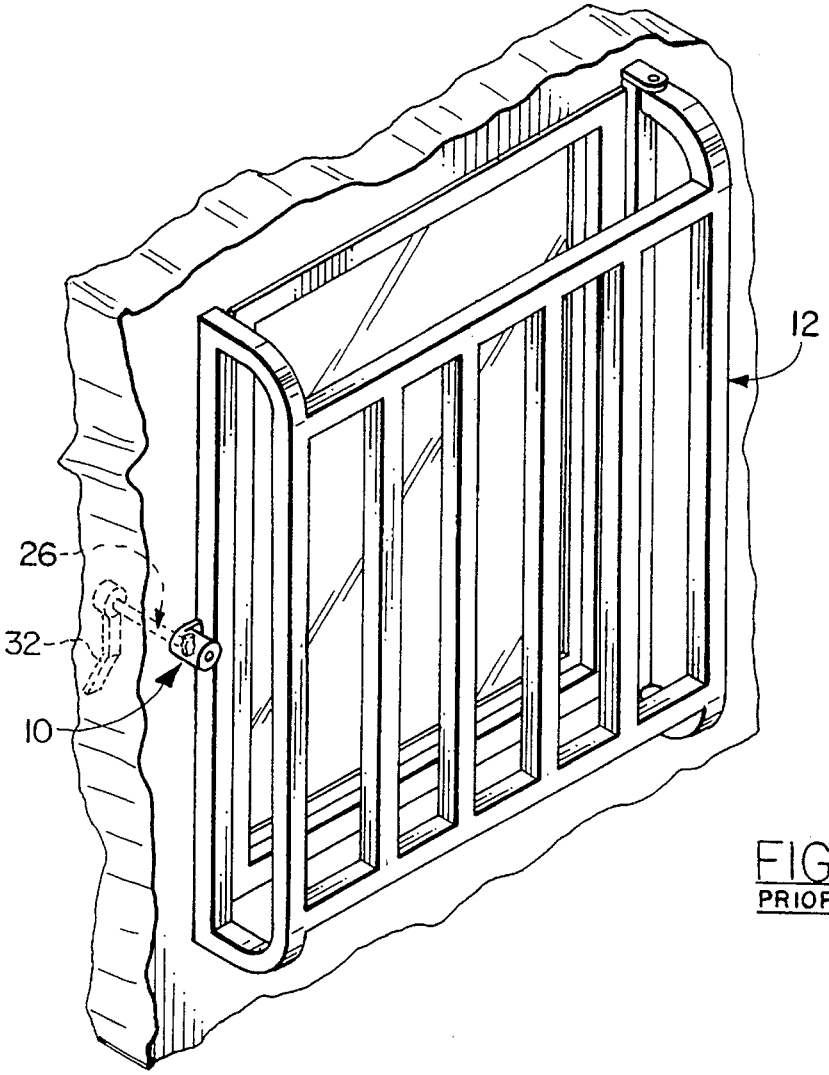
FIG. 1 PRIOR ART
FIG. 1 is a part perspective view of a building with a window over which is hingedly mounted a window guard in a latched closed position by a conventional window guard locking device.
Figure 2:
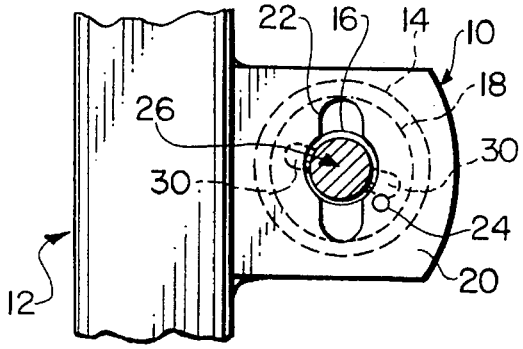
FIG. 2 PRIOR ART
FIG. 2 is a front elevational view of the prior art window guard locking device shown in a locked position.
Figure 3:
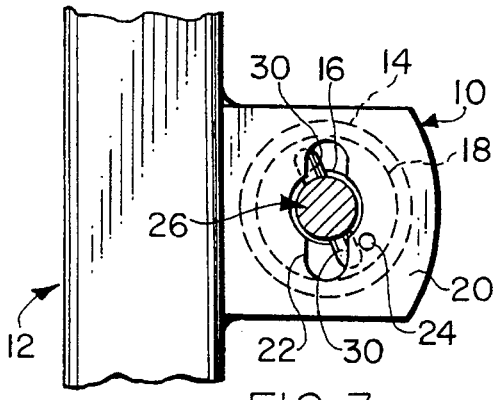
FIG. 3 PRIOR ART
FIG. 3 is a view similar to FIG. 2 showing the locking lobes of the locking member positioned under the flange member of the prior art window guard locking device with the lower locking lobe against the pin in an attempt to pen the guard but having gone past correct alignment.
Figure 4:
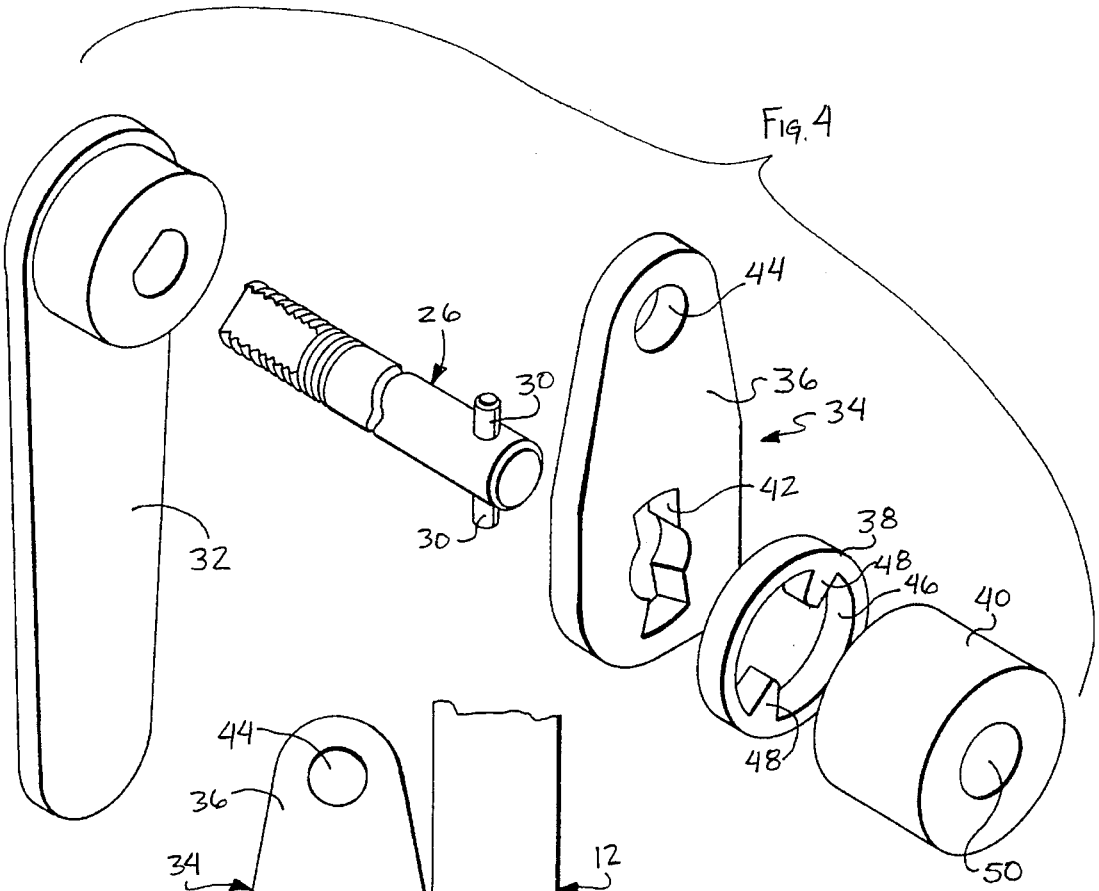
FIG. 4 is a perspective exploded view of the window guard locking device of the present invention.
Figure 5:
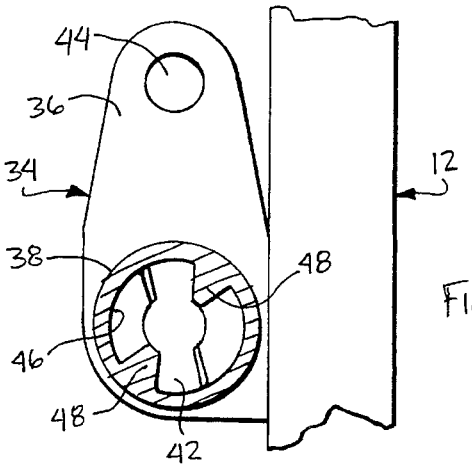
FIG. 5 shows the window guard locking device secured on a window guard with the member having the central cavity removed and showing the position of the projections of the intermediate member relative to the keyhole of the flange member.

FIGS. 1–3 show a conventional window guard locking device 10 secured onto one side of a conventional metal window guard 12 which is hingedly mounted along the other side to a window frame of a building so as to protect unauthorized entry into the building through the window when the window guard is in a locked position as shown in FIG. 2.

The window guard locking device 10 includes a member 14 having a central cavity 16 and an outer annular recess 18 in communication with the central cavity 16. A flange member 20 is secured to the member 14 and is used to secure the window guard locking device to the window guard 12 as by welding or in any other suitable manner.

A keyhole 22 extends through the flange member 20 with the axis of the central cavity 16, the annular recess 18 and the keyhole being aligned. The length of the keyhole 22 is at least equal to the diameter of annular recess 18. A pin 24 extends through flange member 20, across annular recess 18 and is secured in the bottom surface of annular recess 18, pin 24 being located just to the right of the bottom section of keyhole 22 or at about five o'clock.

Figure 6:
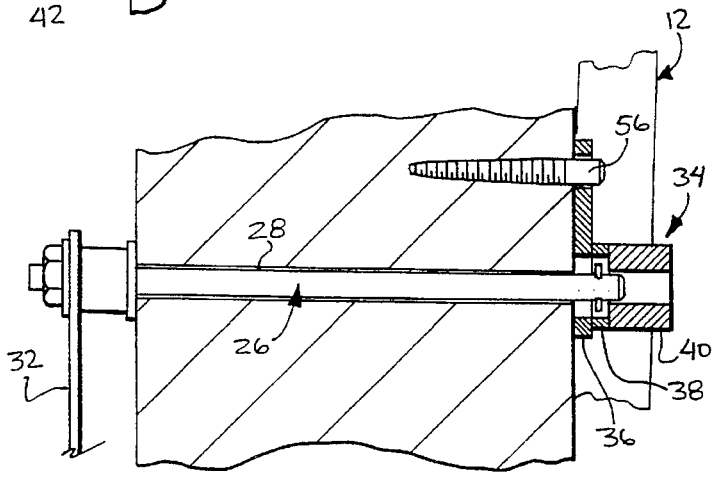
FIG. 6 is a cross-sectional view of the locking member extending through the window frame with the locking lobes in the opening of the intermediate member in a locked position.

A shaft 26 in the form of a movable locking member extends through a hole 28 (FIG. 6) in the window frame and includes a locking section at an end that extends outwardly from outside the window frame and an operating section that extends outwardly from inside the window frame.

The locking section includes a pin positioned back from the front end forming locking lobes 30 and the operating section has a D-shape onto which a handle 32 is secured.

To close the window guard 12, the locking lobes 30 are positioned in a vertical orientation. The window guard is moved to the closed position as shown in FIG. 1 so that the locking section moves through the keyhole 22 with the front end thereof extending along central cavity 16 and the locking lobes 30 being positioned within annular recess 18. Handle 32 is moved in a rotational clockwise direction to at least a ninety degree position so that locking lobes 30 are positioned behind flange member 20 thereby locking window guard 12 in position over the window. Locking lobes 30 can be moved rotational clockwise to abut pin 24 if desired.

To unlock the window guard, handle 32 is moved in an opposite rotational counterclockwise direction causing locking lobes 30 to move in a likewise direction until the locking lobes 30 are vertical thereby enabling the window guard to be unlocked by pushing the window guard open. However, if the locking lobes 30 are not in a vertical position and are turned past the vertical position they would again be behind flange member 20 preventing unlocking of the window guard. This can happen in an emergency situation whereby as a result of panic the locking lobes 30 do not reach the vertical position or they travel there beyond with the bottom locking lobe 30 engaging pin 24. Thus, the handle will be moved back and forth in haste attempting to vertically position the locking lobes 30 so that the window guard can be unlocked. This can take valuable time resulting in a disastrous situation.

The present invention overcomes this drawback. FIGS. 4–8 show the window guard locking device 34 secured to one side of the window guard 12. Locking device 34 includes a flange member 36, an intermediate member 38 and member 40 secured together as a unitary device. Flange member 36 has a keyhole 42 adjacent the bottom and a hole 44 adjacent the top. Intermediate member 38 has an opening 46 with opposing projections 48 extending inwardly from the wall of opening 46; projections 48 being disposed on each side of a vertical plane passing through the axis of the keyhole 42 with the projections being located at about one and seven o'clock. Member 40 has a central cavity or hole 50 therein. The axis of keyhole 42, opening 46 and central cavity 50 are coincident when members 36, 38, 40 are secured together. Members 36, 38, 40 may be cast as a unitary locking device. The surfaces of projections 48 adjacent keyhole 42 are aligned with the respective walls of keyhole 42. The walls of keyhole 42 opposite the walls adjacent projections 48 are tapered inwardly.

Figure 7:
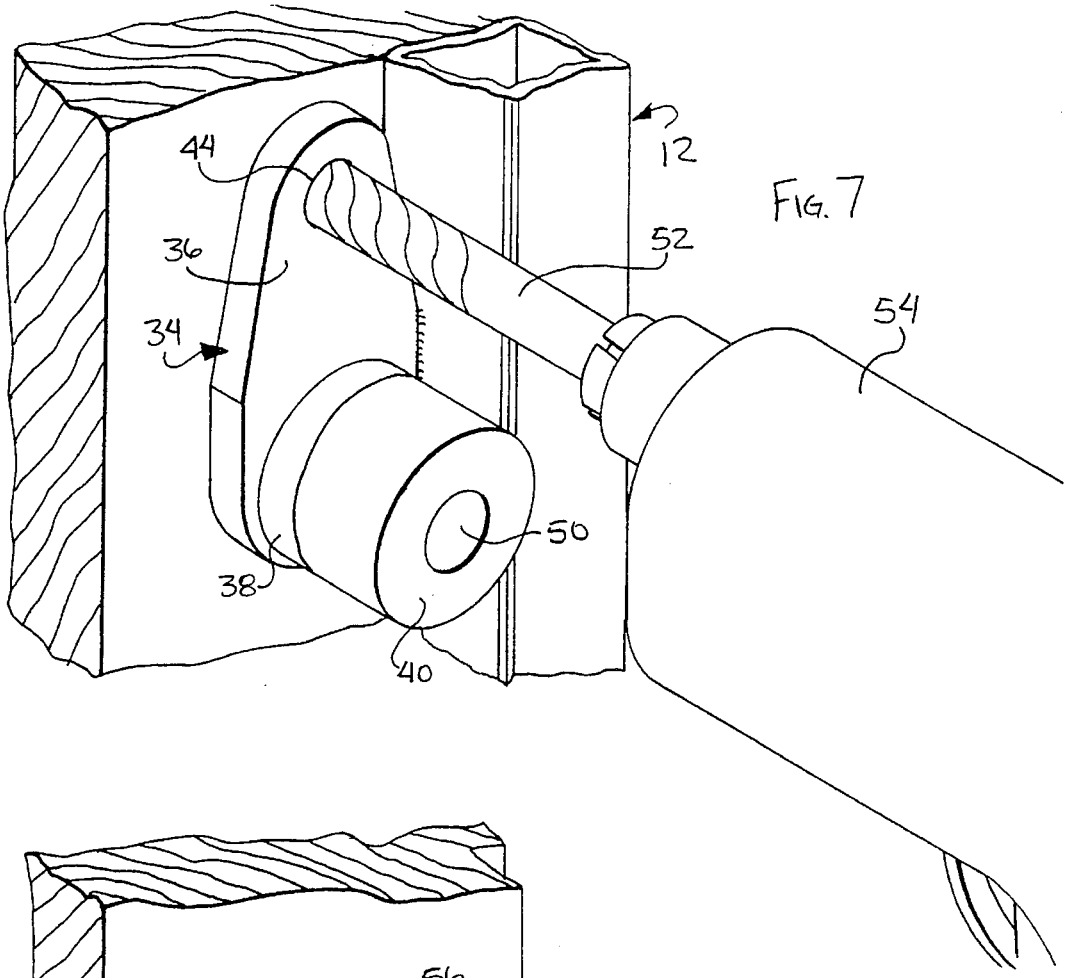
FIG. 7 is a part perspective view of a drill and window guard locking device for drilling a hole in the window frame for a locating pin.
Figure 8:
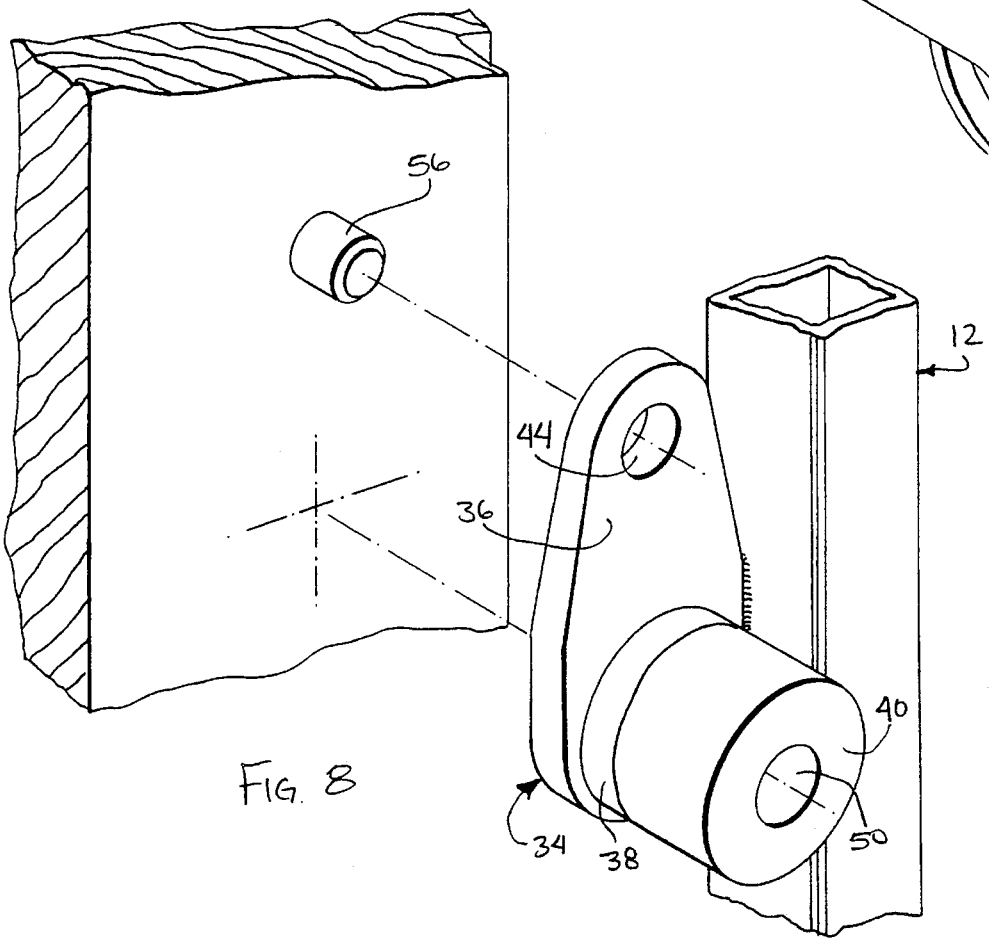
FIG. 8 is a view similar to FIG. 7 showing the locating pin in position in the window frame.

As shown in FIG. 7, window guard locking device 34 is secured to the unhinged side of window guard 12 whereafter it is positioned against the window frame of the building. A drill bit 52 operated by an electric drill 54 is passed through hole 44 in flange member 36 thereby drilling a hole in the window frame. A pin 56 is threadably secured in the drilled hole and serves to position window guard locking device 34 to receive the locking section of the locking member 26 and to be a guide for drilling the hole in the window frame under pin 56 in which locking member 26 is positioned. Thus, after pin 56 is secured in the window frame, locking device 34 is positioned against the window frame with pin 56 extending through hole 44, a drill bit extends through hole 50, opening 46 and keyhole 42 and a hole is drilled through the window frame to the inside thereof. A larger drill bit is then used to make the hole larger to receive locking member 26 which is pushed through the hole so that the locking section extends outwardly from the outside of the window for receipt in the window guard locking device 34. Handle 32 is secured onto locking member 26 to operate it between locked and unlocked positions.

In operation, locking lobes 30 are positioned in a vertical position so that the window guard 12 can be moved to a closed position with pin 56 extending through hole 44 of the flange member 36 and the locking section disposed within keyhole 42, opening 46 and central hole 50 with locking lobes 30 located in opening 46 of the intermediate member 38. Locking member 26 is moved via handle 32 in a clockwise direction causing locking lobes 30 to be under flange member 36 thereby locking the window guard against the window frame. The clockwise movement of locking lobes 30 causes them to move along the tapered surfaces of the keyhole walls until the locking lobes 30 move under flange member 36 thereby drawing the window guard tight against the window frame.

To unlock the window guard, handle 32 is moved counterclockwise causing locking member 26 and locking lobes 30 to move likewise until they engage projections 48 whereby locking lobes 30 are in a vertical position enabling the window guard to be opened. Thus, when locking member 26 is moved to the unlocked position, locking lobes 30 will move to the vertical position when they engage projections 48 and they will not be positioned under the flange member thereby enabling the window guard to be easily opened and not creating a panic situation. If desired, only one projection 48 need be used so long as the surface adjacent the keyhole is coincident with the respective wall of the keyhole. Handle 32 can be connected to a foot-operated mechanism (not shown) to operate the locking member.

I claim:

1. A window guard locking device securable onto a window guard hingedly mounted onto a building and lockable in a locked position over a window by locking lobes of a movable locking member extending outwardly from the window adjacent the window, the window guard locking device comprising:

a member having a central cavity;

a flange member having a keyhole therethrough;

an intermediate member having an opening with a diameter at least equal to said keyhole secured between said member and said flange member with the axis of the keyhole, the opening and the central cavity being aligned; and opposing projections extending inwardly from a wall of said opening with surfaces of the opposing projections being adjacent with respective walls of said keyhole so that when the locking lobes are moved from a locked position under said flange member within said opening to an unlocked position, the locking lobes engage said surfaces of the opposing projections adjacent with the respective walls of said keyhole whereby the locking lobes are aligned with the keyhole thereby enabling the window guard locking device to be moved free of the locking member by pushing open the window guard.

2. A window guard locking device as claimed in claim 1, wherein said central cavity is a hole.

3. A window guard locking device as claimed in claim 1, wherein said flange member has a hole above the keyhole for engagement with a pin adjacent the window.

4. A window guard locking device as claimed in claim 1, wherein the other walls of the keyhole opposite the walls aligned with the projections are tapered inwardly.

5. A window guard locking device, comprising:

a flange member having a keyhole therethrough;

a member having a central cavity;

an intermediate member having an opening disposed between said flange member and said member with an axis of said keyhole, said opening and said central cavity being coincident; and at least one projection extending inwardly from a wall of said opening adjacent but not coincident said keyhole with a surface of said projection being aligned with a respective wall of said keyhole.

6. A window guard locking device as claimed in claim 5, wherein said central cavity is a hole.

7. A window guard locking device as claimed in claim 5, wherein said flange member has a hole above said keyhole.

8. A window guard locking device as claimed in claim 5, wherein another projection extends inwardly from said wall opposite said one projection and has another surface aligned with another respective wall of said keyhole.

9. A window guard locking device as claimed in claim 8, wherein further walls of the keyhole opposite the walls aligned with the projections are tapered inwardly.

10. A window guard locking device secured onto a window guard hingedly mounted onto a building and lockable in a locked position over a window, comprising:

a unitary device having a keyhole at an inner end, a cavity at an outer end and a circular opening positioned between said keyhole and said hole, an axis of said keyhole, opening and cavity being coincident, a wall of said opening having opposing projections extending inwardly on each side of a plane passing through said axis so that surfaces of said projections are aligned with respective surfaces of said keyhole; and a movable locking member having a shaft extending through a hole in a window frame including a locking section at one end that extends outwardly from outside the window frame and an operating section at the other end that extends outwardly from inside the window frame, locking lobes provided at said locking section and a handle provided at said operating section;

said locking lobes extending through said keyhole and into said opening when the window guard is moved to a closed position over the window whereby the locking lobes are moved so as to be positioned along said opening under an inner surface of said keyhole thereby locking the window guard in a locked position, said locking lobes being moved to engage the surfaces of said opposing projections whereby the locking lobes are aligned with the keyhole thereby enabling the unitary device to be moved free of the locking member by pushing open the window guard.

11. A window guard locking device as claimed in claim 10, wherein said unitary device includes a flange member in which the keyhole is located, a member in which the cavity is located, and an intermediate member in which said circular opening is located.

12. A window guard locking device as claimed in claim 11, wherein said flange member has a hole above said keyhole aligned therewith for mounting said unitary device onto the window frame.

13. A window guard locking device as claimed in claim 12, wherein said cavity in said member is a hole whereby the unitary device acts a guide for drilling the window guard hole in which said shaft is disposed.

14. A window guard locking device as claimed in claim 10, wherein further surfaces of the keyhole opposite the surfaces aligned with the projections are tapered.

* * * * *